United States Patent [19]

Klein et al.

[11] Patent Number: 4,625,648

[45] Date of Patent: Dec. 2, 1986

[54] PROJECTILE PROPELLING CHARGE AND METHOD OF MANUFACTURE THEREOF

[75] Inventors: Georg Klein, Meersbusch; Eckhard Rahnenfuehrer, Dormagen, both of Fed. Rep. of Germany

[73] Assignee: Rheinmetall GmbH, Duesseldorf, Fed. Rep. of Germany

[21] Appl. No.: 656,036

[22] Filed: Sep. 28, 1984

[30] Foreign Application Priority Data

Oct. 1, 1983 [DE] Fed. Rep. of Germany ..... 3335821

[51] Int. Cl.[4] ..... C06D 5/06

[52] U.S. Cl. ..... 102/286; 102/288; 102/292; 102/275.12; 102/443; 264/3.3

[58] Field of Search ..... 102/202.5, 275.9, 275.11, 102/275.12, 283, 288, 292, 286, 443; 264/3 R, 30, 3.1, 3.3

[56] References Cited

U.S. PATENT DOCUMENTS

| | | | |
|---|---|---|---|
| 1,950,019 | 3/1934 | Biazzi | 102/9 |
| 3,078,799 | 2/1963 | Kabik | 102/28 |
| 3,390,210 | 6/1968 | Guenter | 264/3 R |
| 3,937,143 | 2/1976 | Schlueter | 102/28 |
| 3,999,484 | 12/1976 | Evans | 102/28 |
| 4,429,632 | 2/1984 | Yunan | 102/202.13 |
| 4,450,768 | 5/1984 | Bell | 102/307 |

*Primary Examiner*—Peter A. Nelson

[57] ABSTRACT

A propellant charge and method of manufacture thereof by which the increase in maximum gas pressure within the upper use temperature range which occurs upon firing can be influenced until eliminated. The propellant charge is manufactured by compacting a first portion of the propellant charge which corresponds to between 50–80% of the total mass of the propellant charge, and then adding the balance of the propellant charge as loose powder on top of the first portion.

8 Claims, 7 Drawing Figures

PROJECTILE PROPELLING CHARGE AND METHOD OF MANUFACTURE THEREOF

BACKGROUND OF THE INVENTION

The invention relates to a propellant charge and to a method of manufacturing it. For a long time, specialists have been concerned with the design of propellant charges and methods of manufacturing them. An increase in the interior ballistic performance so as to obtain a higher muzzle velocity for a given projectile is one goal of this research.

A known propellant charge and method of manufacture thereof is disclosed in unexamined German patent application No. OS 32 05 152. That application concerns a propellant charge for cartridge ammunition and a method for the manufacture thereof by which the performance is said to be increased as compared with the prior known propellant charges, but without the simultaneous increase in expenditure of work or danger to life as a result of solvent vapors. The propellant charge powder bodies are compressed in the cartridge case to a charge density of between 1.0 and 1.5 g/cm$^3$ by the application of external pressure, without the addition of binders and/or solvents, and they are deformed elastically to plastically by an approximately uniform or gradually varying compression, individual quantities being compressed with the same or different pressures in individual sections uniformly or with gradual difference in the cartridge case. These measures are all directed at increasing the mass which is to be placed in a given cartridge case by compressing all or part of the propellant charge.

As a result of the elimination of binders and/or solvents, the danger in manufacture is reduced. However, the methods indicated above do have several disadvantages. After compacting, measures must be taken by means of a special covering to stabilize a free pressing rim or the charge surface of the compressed propellant charge powder body against crumbling and/or ejection of the pressing surface. Since several compacting steps are necessary, the cartridge case in question must, for reasons of safety, be brought into a separate room for the compacting after each introduction of loose propellant charge powder.

In order to fully understand the background of the present invention, several distinctions must be made regarding gas pressure in gun barrels. First, there is what is called the "design gas pressure" which is a theoretical maximum gas pressure a gun barrel will tolerate without causing a permanent change in shape of the gun barrel. Next, there is what is called the "acceptance gas pressure" which is the pressure to which a new gun barrel is subjected one or more times in order to check its safety. The acceptance gas pressure is close to the design gas pressure and generally slightly less than it. Next, there is the "maximum permissible gas pressure", which, except upon the acceptance check, must not be exceeded even under unfavorable conditions. There is also the "average gas pressure" at 50° C. powder temperature, which is below the maximum permissible gas pressure. Finally, there is the "average maximum gas pressure" at 21° C. powder temperature, which is used under Central European conditions as a reference value for the life of gun barrels.

By way of further explanation, two diagrams are attached FIGS. 1*a* and 1*b*). These figures show, in a case of loosely poured powder charge, the influence of use temperature on muzzle velocity and on average maximum gas pressure. The basis for these figures is a propellant powder charge which has no abnormality in pressure in the lower use temperature range, for example in the form of pressure peaks.

One essential fact which can be noted from the diagrams is that the gas pressure increases with the temperature of use, hand in hand with which there is an increase in the muzzle velocity, by its sharp rise towards the maximum permissible gas pressure. The p,T curve shows that there is a sensitive limit established by said gas pressure.

SUMMARY OF THE INVENTION

The object of the present invention is the creation of a propellant charge by which, within the upper use-temperature range, the increase in maximum gas pressure which occurs upon firing with an increase in the temperature can be controlled up to elimination thereof.

Another object of the invention is to provide a simple method for the manufacture of such a propellant charge.

In accordance with the present invention, a propellant charge powder for which, upon lose pouring, without binder and/or solvents, a p,T curve in accordance with the above-indicated diagram is obtained.

FIRST EXAMPLE

An initial portion (that is about 50 to 80%) of the total mass N of the charge is preferably at least partially compacted. A second portion, being the balance of the total mass N, is piled loosely upon the first portion. In this way, the afore-mentioned increase in pressure with an increase in temperature can be advantageously controlled until eliminated. The increase in performance consists in the possibility of firing a gun barrel which is designed for a given maximum gas pressure with a propellant charge which, in case of a lose filling of the propellant charge powder, would no longer be permissible at higher use temperatures due to the steep slope of the p,T curve.

SECOND EXAMPLE

If a gun barrel having a higher maximum permissible gas pressure is available, then one can start from a total mass of M greater than N. If one proceeds in the manner described above, an increase in interior ballistic performance will be obtained at a pressure p less than maximum permissible pressure.

Referring to diagrams (FIGS. 2*a* and 2*b*), it is clear that the influence of the use temperature is eliminated upon passage from 21° C. to 52° C. In the first example, the increase in performance is represented by an increase in the life of the gun barrel while in the second example it is represented by a higher muzzle velocity of the projectile.

If the method of the present invention is used directly within a cartridge case having a circular cylindrical cross-section substantially over its entire length, the active surface of a press ram for compacting can correspond to the inside cross-section of the cartridge case, and the first portion can be compacted as a whole.

In the case of a cartridge case having a comparatively smaller inside cross-section at the cartridge mouth (bottle cartridge), a press ram adapted to the latter must be used. In this case, it cannot be avoided that lose propellant charge bodies move within an annular slot between the circumferential surface of the press ram and the inner wall surface of the cartridge case in a direction opposite that of the press ram upon compacting. As a result, only a partial compacting of the first portion takes place. However, this is not detrimental as will be shown below.

If the propellant charge of the invention is to be used in a cartridge case which is at least partially combustible (ammunition within the caliber range of less than 20 mm to more than a 120 mm), it is advisable to compact the fist portion in a comparatively smooth walled device for which the pressure load upon the compacting of the first portion is designed. From this apparatus, the compacted first portion (or partially compacted first portion in the case of a bottle cartridge) can be transferred into the afore-mentioned cartridge case by axial ejection. In order to avoid any detrimental wall friction, a thin walled tube can be arranged within the cartridge case before the transfer and then removed after transfer.

BRIEF DESCRIPTION OF THE DRAWINGS

With these and other objects in view, which will become apparent in the following detailed description, the present invention, which is shown by example only, will be clearly understood in connection with the accompanying drawing, in which.

DETAILED DESCRIPTION OF THE DRAWINGS

Figure 1B:
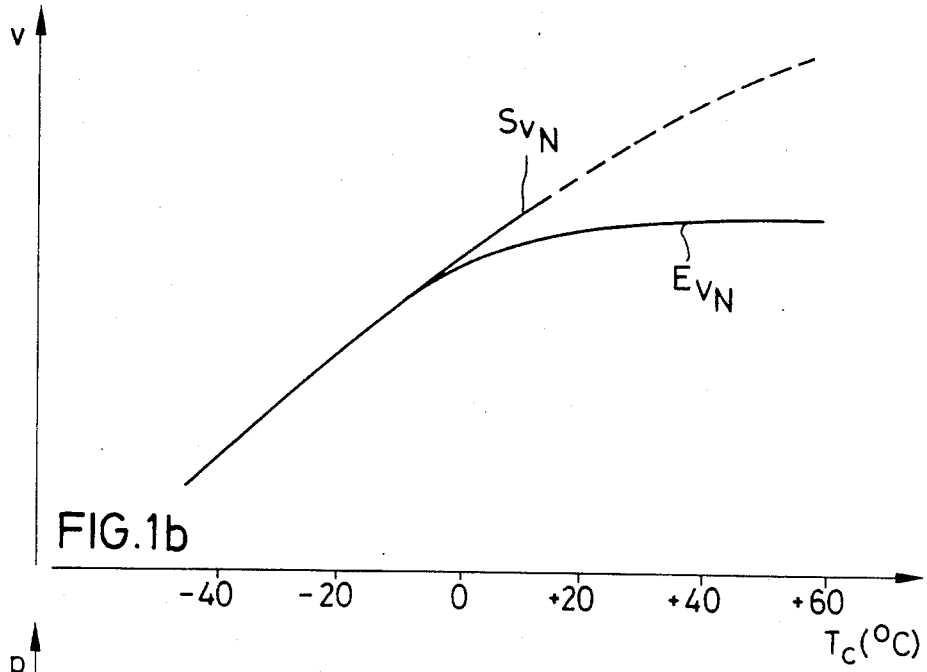
FIG. 1*b* is a velocity/temperature curve.
Figure 1A:
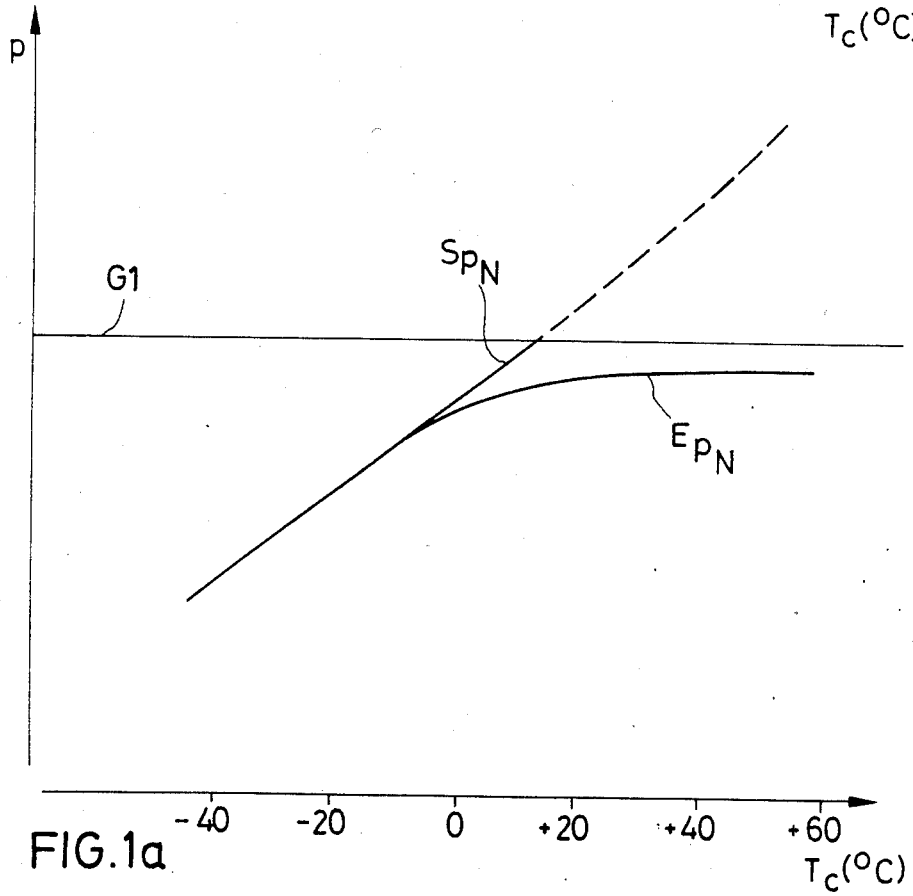
FIG. 1*a* is a pressure/temperature curve.

In FIG. 1*a* the curve $S_{pN}$ shows the behavior of a propellant charge consisting of a propellant charge powder poured loosely into a cartridge case. This curve shows that, in the upper use-temperature range, a horizontal limit G1 (which indicates for a first gun barrel the average maximum permissible gas pressure) is exceeded in a steep rise by the curve $S_{pN}$ (broken line parts). The propellant charge is, accordingly, unsuitable for the use-temperature range in question.

FIG. 1*b* shows a curve $S_{vN}$ plotted for the loosely poured propellant charge.

A curve $E_{pN}$ in FIG. 1*a* shows the behavior of a propellant charge of the invention whose mass N corresponds to that of the loosely poured propellant charge. Within the upper use-temperature range, the curve $E_{pN}$ remains, with a flat course, below the limit G1. By the method of the invention, therefore, with constant mass N of the propellant charge (assuming in both cases an identical cartridge case), the suitability of the propellant charge for the gun barrel in the upper use-temperature region is obtained. This results in a broad increase in performance.

Figure 2B:
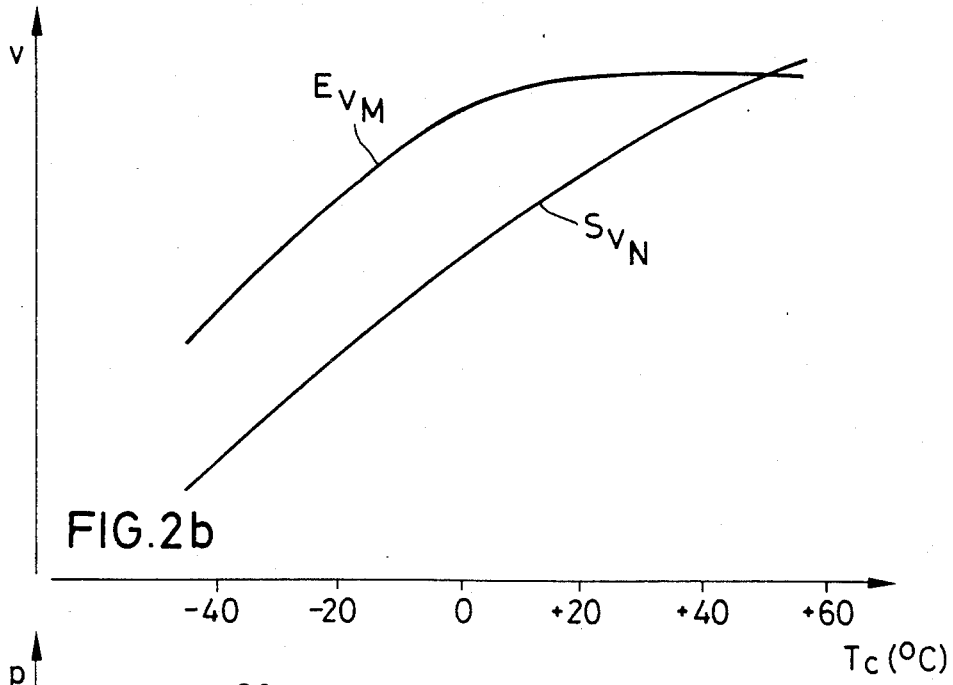
FIG. 2*b* is a velocity/temperature curve.
Figure 2A:
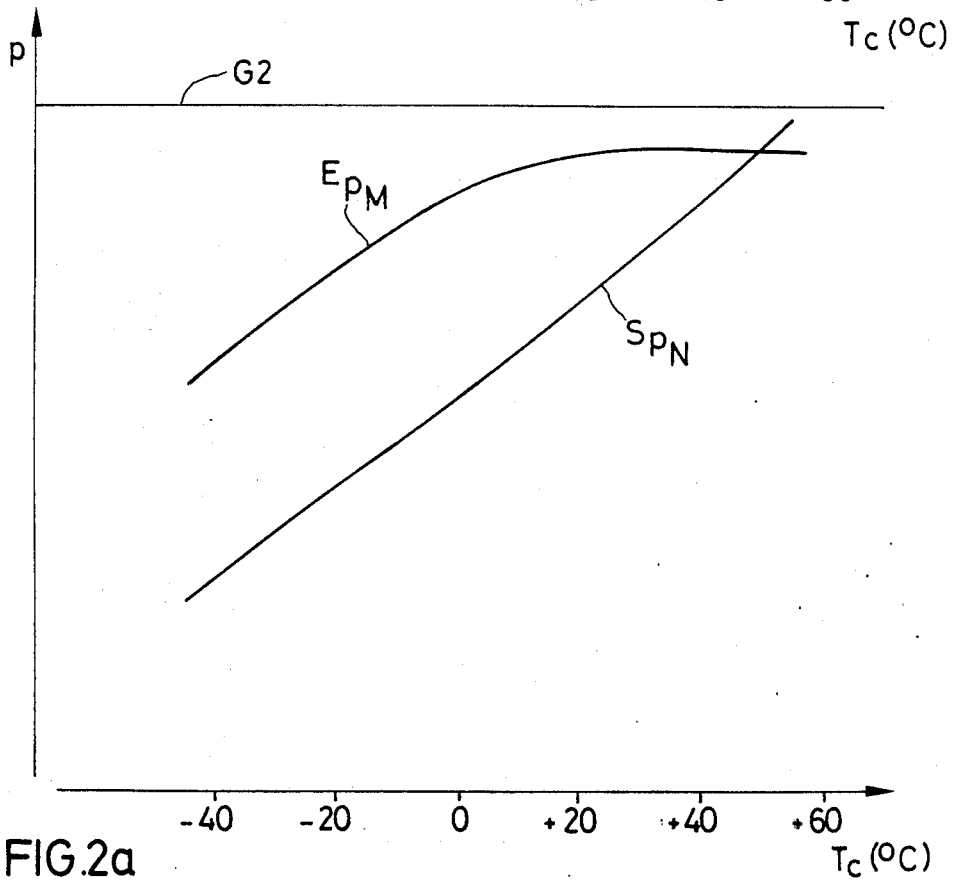
FIG. 2*a* is a pressure/temperature curve.

In both diagrams (FIGS. 2*a* and 2*b*), there are shown two curves, namely $S_{pN}$ and $E_{pM}$ and $S_{vN}$ and $E_{vM}$, respectively. FIG. 2*a* refers to a second gun barrel which can be subjected to a higher stress than the first gun barrel mentioned in connection with FIGS. 1*a* and 1*b*. A horizontal limit G2 is accordingly associated with a higher pressure than the limit G1 in FIG. 1*a*. The corresponding curves $S_{pN}$ and $S_{vN}$ corresponds to those of FIGS. 1*a* and 1*b*, i.e. the same lose propellant charge of mass N is present. The two corresponding curves $E_{pM}$ and $E_{vM}$ characterize the behavior of a propellant charge according to the invention whose mass M is greater than that of the lose propellant charge (mass N) known from FIGS. 1*a* and 1*b*. As in the case of FIGS. 1*a* and 1*b*, an identical cartridge case and the same propellant-charge powder are assumed. From the course of the curve $E_{pM}$ and $E_{vM}$ for the propellant charge of the invention, the increase in interior ballistic performance as compared with the lose propellant charge can be clearly noted. A modified or similar course of the curves $E_{pM}$ and $E_{vM}$ can be obtained with the use of a different propellant-charge powder.

Figure 3:
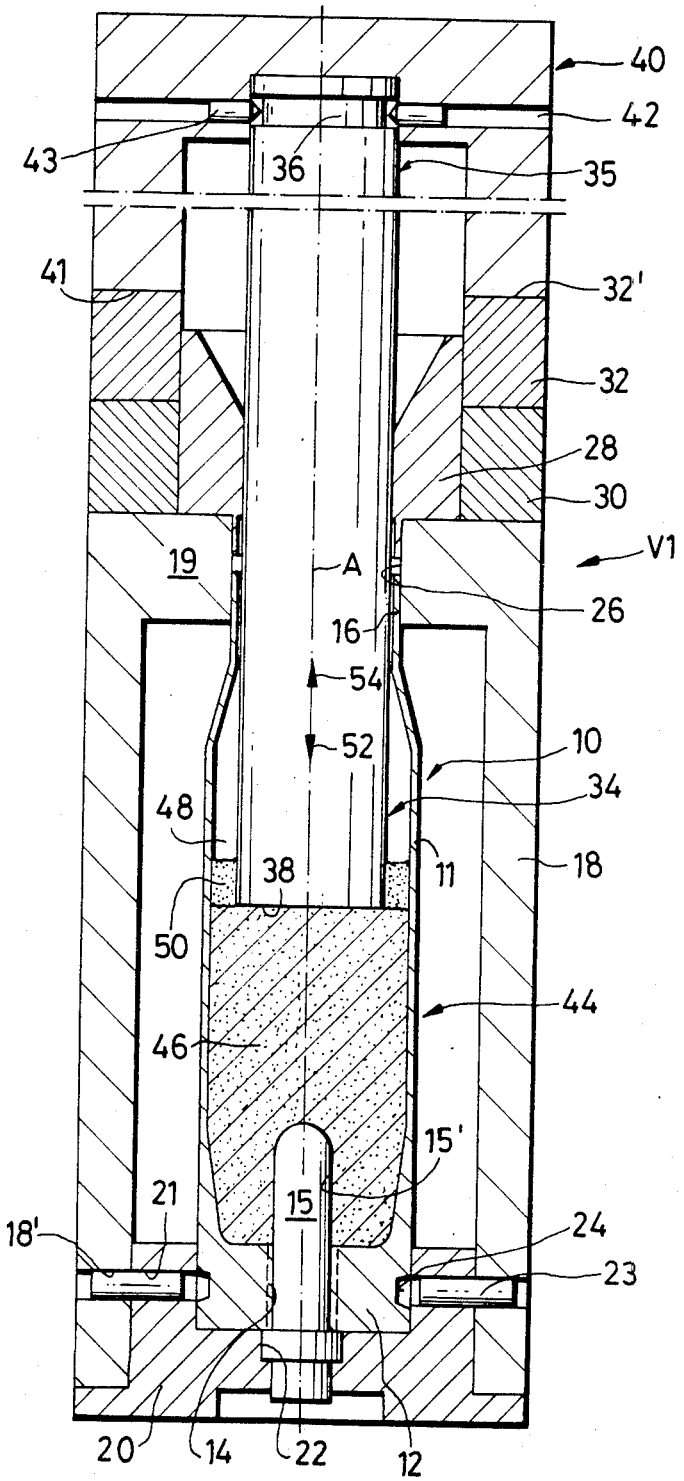
FIG. 3 is a longitudinal axial section showing an apparatus for performing the method of the invention in a bottle shaped cartridge case.

FIG. 3 shows an apparatus V1 for performing the method of the invention in a bottle-shaped cartridge case 10 having a case wall 11 and a case bottom 12. Within the case bottom 12, there is a threaded hole 14 for a propellant charge igniter. The cartridge case 10 terminates at its top in a neck 16.

The apparatus V1 consists of a thick-walled circular cylindrical tube 18 having an inner flange 19 on top. A bottom piece 20 engages at the bottom into the tube 18 and has horizontal locking holes 21 in addition to a central axial receiving hole 22. Locking holes 21 correspond to locking holes 18' in the tube 18. The bottom of the cartridge case 10 is received in the bottom piece 20, fastening means 23 engaging through the holes 18' and 21 in an extractor groove 24 near the bottom of the case 10. For this purpose, cartridge case 10 and bottom piece 20 are first pushed in the direction of arrow 54 into the tube 18 aligned with central longitudinal axis A. The neck 16 of the case is within the region of a coaxial circular opening 26 in the inner flange 19. A funnel 28 is placed on the top surface 19*a* of the inner flange 19 and is surrounded by two spacer rings 30 and 32.

A cylindrical circular press ram 34 has a pressing surface 38 at its bottom and a fastening groove 36 at its upper free end. The free end of press ram 34 is received in a mount 40 having radial holes 42. Fastening means 43, within the holes 42, engage into the groove 36 and hold the press ram 34 in the mount 40.

A first portion of a propellant charge in the form of lose powder is introduced through funnel 28. This first portion comprises about 50 to 80% of the total mass of the propellant charge to be introduced. After the introduction of the first portion 44 into the cartridge case 10, the mount 40 together with the press ram 34, which is held fast in it, is moved in a direction of arrow 52 with the application of a predetermined pressure. The pressing surface 38 comes into contact with the surface (not shown) of the lose pile and a part 46 of the first portion 44 is compacted. Since the outside diameter of the press ram 34 is smaller than the free inside diameter of the cartridge case 10 in the region of wall 11, an annular cylindrical cavity 48 remains within which there is a small amount 50 of uncompacted propellant charge powder.

The compacting of the part 46 of the first portion 44 is completed as soon as bottom annular surface 41 of mount 40 contacts with top annular surface 32' of top spacer ring 32. After a release of pressure, mount 40 together with press ram 34 are moved in the direction of the arrow 54 until the funnel 28 is released. Thereupon, a second portion of propellant charge, (which constitutes the balance of the total mass) is piled loosely onto the first portion 44.

A dummy plug 15 is arranged in the threaded bore 14 for the propellant charge igniter and in the receiving hole 22 of the bottom piece 20. The part of the dummy plug 15 which protrudes into the inside of cartridge case 10 is substantially equal in dimensions to the propellant charge igniter. Therefore, after removal of the dummy plug 15, the propellant charge igniter can be easily introduced into channel 15' which remains in the compacted part 46 after removal of the dummy plug 15.

Figure 4:
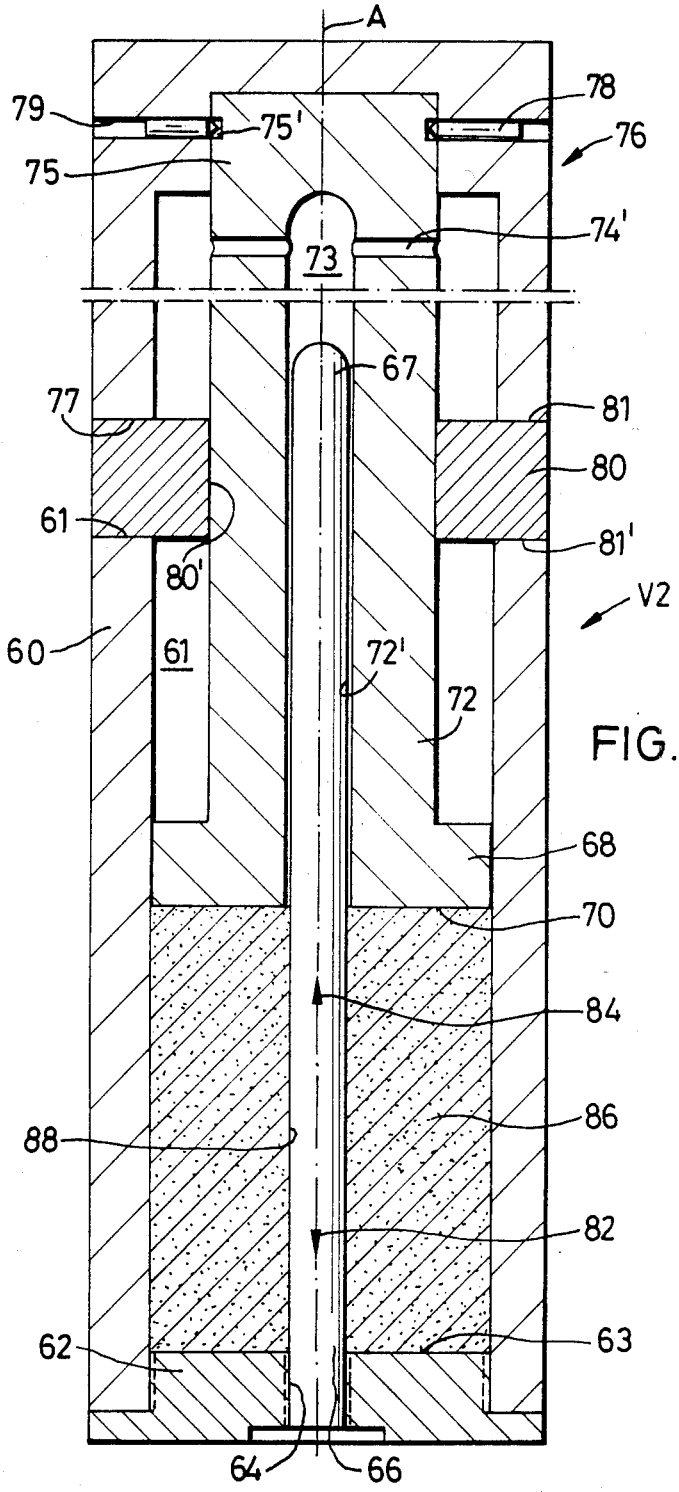
FIG. 4 is a longitudinal axial section of an apparatus for performing the method of the invention outside a cartridge case.

FIG. 4 shows an apparatus V2 having an annular cylindrical tube 60 of sufficient wall thickness, into the bottom of which a bottom piece 62 is inserted. Bottom piece 62 has a central axial threaded hole 64 to receive a dummy plug 66. A press ram 68, whose outside diameter corresponds to the inside diameter to tube 60, has a bottom pressing surface 70 and an actuating rod 72. Central axial hole 72' creates an inner space 73 which extends into the free upper end 75 above rod 72. Vent holes 74' connect the inner space 73 with the outside atmosphere. Radial holes 79 are provided in mount 76. Bolt-like fastening means 68 extend through holes 79 and, via recess 75', hold the press ram 68 together with its rod 72 fast in the mount 76. A spacer ring 80 has a central opening 80' which is adapted to the outside diameter of rod 72. The flat bottom 81' of spacer ring 80 lies on the top flat annular surface 61 of the tube 60.

Before the introduction of the first portion of propellant charge in the form of lose powder into inner space 61, the press ram 68 is removed. After press ram 68 has been pushed past the spacer ring 80, it is held fast in the mount 76 and moved in the direction of arrow 82 along the central longitudinal axis A, applying pressure against the lose pile of powder in the first portion of the propellant charge.

The dummy plug 66 which protrudes beyond the top surface 63 of the bottom plug 62 corresponds essentially to the dimensions of a propellant charge igniter. Upon the downward movement of press ram 68, the free end 67 of the dummy plug 66 comes into the bore hole 72', and the air from the inside 73 can escape through vent openings 74'.

The first portion 86 of the propellant charge is compacted as soon as the bottom annular surface 77 of the mount 76 contacts the top surface 81 of the spacer ring 80.

If the propellant charge is to be introduced into a metal cartridge case of cylindrical inner cross-section, it can, provided with dummy plug 66, be introduced from below into the tube 60 whose inside diameter is adapted to the outside diameter of the cartridge case. In this case, the outside diameter of press ram 68 must be adapted to the inside diameter of the metal cartridge case (not shown).

Figure 5:
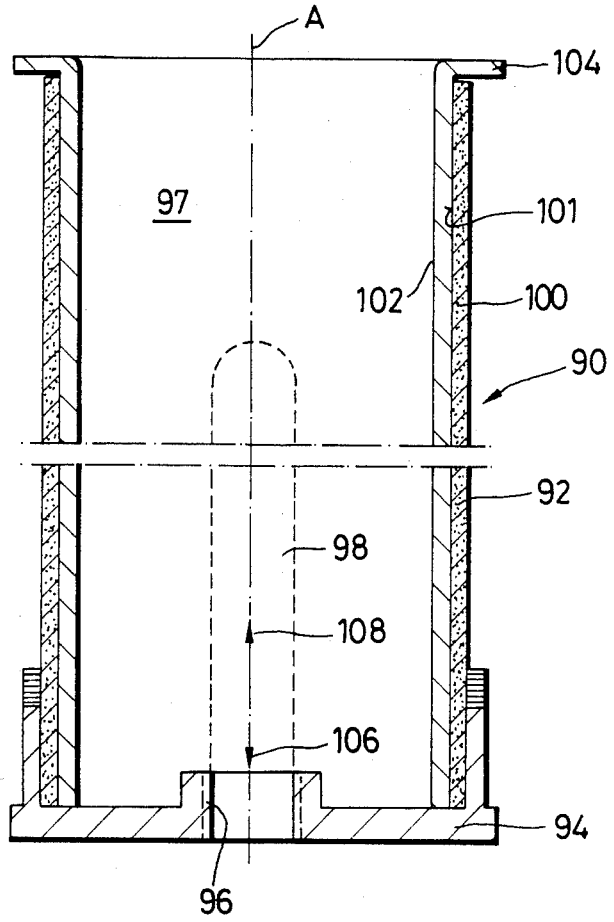
FIG. 5 is a longitudinal axial section of an at least partially burnable cartridge case which is adapted to receive a portion of a propellant charge according to the invention and which has been compacted in the apparatus shown in FIG. 4.

If the propellant charge is to be placed in a cartridge case according to FIG. 5, the following procedure is used:

The cartridge case 90 has a bottom 94 with a central axial threaded hole 96 for a propellant charge igniter 98. A burnable portion 100 of the cartridge case 90 is firmly attached to the bottom 94. The first portion 86 (FIG. 4) of the propellant charge which has been compacted in the apparatus V2 of FIG. 4 may now be transferred into the interior 97 of the cartridge case 90.

In order to prevent damage to an inner wall surface 101 of the burnable part 100 of the cartridge case 90, a metal sleeve 102 (shown, for purposes of clarity, with an excessively thick wall in the drawing) adapted to the inside diameter of the burnable part 100, is introduced into the inner space 97.

After removal of the bottom piece 62 and dummy plug 66 (see FIG. 4), the arrangement shown in FIG. 5 is fastened in axial alignment below the device V2 shown in FIG. 4. Upon the ejection of the compacted first portion 86 of the propellant charge, the propellant charge igniter 98 passes into a channel 88 formed by the dummy plug 66. As soon as the compacted first portion 86 of the propellant charge has been brought into the cartridge case 90, the smooth metal sleeve 100 is removed at its top rim 104 in the direction of the arrow 108 from the cartridge case 90, and the second portion of the propellant charge is introduced as a loose powder.

In the case of a propellant charge igniter which is substantially longer than the dummy plug 15 of FIG. 3 the press ram 35 must be provided with a central axial bore for the longer dummy plug as is the ram 72 shown in FIG. 4.

The spacer rings 30, 32, and 80 in FIGS. 3 and 4 are replaceable so that the depth of penetration of the press ram 34 or 68 can be changed in order to determine a predetermined compacting of the corresponding first portion 44 or 86, respectively.

Although the invention is described and illustrated with reference to a plurality of embodiments thereof, it is to be expressly understood that it is in no way limited to the disclosure of such preferred embodimemts but is capable of numerous modifications within the scope of the appended claims.

We claim:

1. An improved cartridge casing holding a propellant charge and having a projectile operatively mounted thereon, the improvement comprising (a) a first predetermined portion of said propellant charge is disposed in the bottommost portion of said casing, said first portion consisting of loose powder without binders or solvents which is thereafter compressed;

(b) said first portion forming 50–80% of the total mass of the propellant charge;

(c) a cylindrically shaped propellant charge ignitor having a predetermined exterior diameter, the bottom of said casing having an axial bore which extends at least partially into said first portion, the interior diameter of which corresponds to the outer diameter of said igniter; and (d) a second predetermined portion of said propellant charge forms the rest of the entire propellant charge mass and consists of loose powder which poured into said casing so as to confront the projectile mounted thereon.

2. In a propellant charge casing, a method of manufacturing a propellant charge, comprising the steps of (a) introducing the casing into a pipe-shaped tube and fixedly holding therein;

(b) introducing a cylindrically shaped blank into the axial bore in the bottom of the casing, the outer diameter of the blank corresponding to the diameter of the axial bore and to the exterior diameter of a cylindrically shaped igniter which is to be subsequently mounted therein;

(c) a predetermined first portion is poured into the casing through its open top as loose powder;

(d) a press die having an exterior diameter corresponding to the interior diameter of the casing is introduced therein and is advanced to such extent until a predetermined compression of said first portion is achieved; and (e) the press die is pulled out of said casing and a second portion of said loose powder is poured into said casing through its open top.

3. A method of manufacturing a propellant charge, comprising the steps of (a) pouring a first portion of loose propellant charge powder into a cylindrically shaped container having an interior diameter which corresponds to the outer diameter of a to be compressed first portion of the propellant charge and having a rod which axially upwardly extends through a central bore in the removable bottom of the container, and compressing said first portion to a predetermined degree by means of a press die matingly slidably mounted in said container and on said rod whose diameter corresponds to that of an igniter which is to be subsequently mounted in said central bore;

(b) removing said bottom and the rod mounted in the central bore thereof from said container thereby leaving a central bore in said compressed first portion and inserting a casing having a bottom and igniter fixedly mounted therein through the bottom end of said container;

(c) pressing said first portion of said propellant charge into said casing by means of said press die whereby said igniter slides into the central bore of said compressed first portion; and (d) detaching the propellant charge casing from said container and thereafter pouring a second portion of loose powder into the top end of the casing.

4. The method of manufacturing a propellant charge as set forth in claim 3, wherein the casing is combustible and prior to mounting the casing in the container a metal sheathing is mounted on the casing and is removed through the top end of the container by means of a radially bent upper edge which covers the upper edge of the combustible casing after the first propellant charge portion has been slid into the combustible casing.

5. A method according to claim 1, wherein the first portion is from 50–80% of the total mass of the propellant charge.

6. A method according to claim 1, wherein the total mass of the propellant charge corresponds to the mass which can be received by an identical cartridge case as a loose pile of the same propellant charge powder.

7. A method according to claim 1, wherein the total mass of the propellant charge corresponds to a mass which is greater than the mass which can be received by an identical cartridge case as a loose pile of the same propellant charge powder.

8. A method according to claim 1, wherein the first portion and second portion are of different chemical composition.

* * * * *